US007472719B2

(12) United States Patent
Dallmer

(10) Patent No.: US 7,472,719 B2
(45) Date of Patent: Jan. 6, 2009

(54) DRAINAGE DEVICE FOR ARRANGEMENT ON A FLOOR TILE HAVING A DRAIN WATER APERTURE AND ARRANGEMENT OF SUCH A DRAINAGE DEVICE ON A FLOOR TILE

(75) Inventor: Johannes Dallmer, Arnsberg (DE)

(73) Assignee: Dallmer GmbH & Co. KG, Arnsberg (DE)

( * ) Notice: Subject to any disclaimer, the term of this patent is extended or adjusted under 35 U.S.C. 154(b) by 245 days.

(21) Appl. No.: 11/314,085

(22) Filed: Dec. 22, 2005

(65) Prior Publication Data

US 2007/0017578 A1 Jan. 25, 2007

(30) Foreign Application Priority Data

| | | |
|---|---|---|
| Dec. 23, 2004 | (DE) | 10 2004 063 420 |
| Mar. 26, 2005 | (DE) | 10 2005 013 943 |
| Aug. 1, 2005 | (DE) | 10 2005 036 576 |

(51) Int. Cl.
*A47L 3/00* (2006.01)
*F16L 5/00* (2006.01)

(52) U.S. Cl. ..... 137/362; 4/613

(58) Field of Classification Search ..... 137/362; 4/613; 285/136.1

See application file for complete search history.

(56) References Cited

U.S. PATENT DOCUMENTS

| | | | | |
|---|---|---|---|---|
| 1,792,345 | A * | 2/1931 | Williams | 137/362 |
| 2,299,705 | A * | 10/1942 | Svirsky | 4/613 |
| 2,484,240 | A * | 10/1949 | Morthland | 4/613 |
| 4,694,513 | A * | 9/1987 | Kiziah | 4/613 |
| 5,022,430 | A * | 6/1991 | Degooyer | 137/362 |
| 5,216,767 | A * | 6/1993 | Elmore | 4/613 |
| 7,178,179 | B2 * | 2/2007 | Barnes | 4/507 |

FOREIGN PATENT DOCUMENTS

| | | |
|---|---|---|
| AU | 710604 | 9/1999 |
| DE | 30 20 634 A1 | 12/1981 |
| DE | 42 06 512 A1 | 9/1993 |
| DE | 101 12 546 A1 | 10/2002 |
| DE | 102 01 345 | 7/2003 |
| EP | 1 329 562 A3 | 7/2003 |
| EP | 1 561 868 A2 | 8/2005 |
| GB | 2 210 392 | 6/1989 |
| WO | WO 99/39057 | 8/1999 |

* cited by examiner

*Primary Examiner*—John Fox
(74) *Attorney, Agent, or Firm*—Hoffman, Wasson & Gitler

(57) ABSTRACT

Drainage device for arrangement on a floor tile, the drainage device, when at least partially assembled in the floor, has at least two pipe lengths moveable relative to one another in such a way that a movement of the pipe lengths relative to one another allows an aperture in the floor tile and the upper inlet aperture of the drainage device to be made to coincide at least partially with one another. At the same time the pipe lengths have flanges extending radially outwards, which are sealed against one another by seals.

14 Claims, 10 Drawing Sheets

1
44
36
16
X
6
51
50
47
46
49
48
3
4
2
45
49

18
43
42
5
7
45
8
14
9
15

DRAINAGE DEVICE FOR ARRANGEMENT ON A FLOOR TILE HAVING A DRAIN WATER APERTURE AND ARRANGEMENT OF SUCH A DRAINAGE DEVICE ON A FLOOR TILE

BACKGROUND OF THE INVENTION

The present invention relates to a drainage device for arrangement on a floor tile having a drain water aperture according to the preamble of claim 1 and to an arrangement of such a drainage device on a floor tile.

Fitting drainage devices to floor tiles, which may be composed of natural stone, for example, is already known. Such natural stone tiles, which have a slope towards the central aperture, for example, can be very heavy and unwieldy. It may be difficult to place such a natural stone tile in the corner of a room, for example in a shower tray. This is the case particularly when the upper inlet aperture of the drainage device, already partially preinstalled in the floor, does not align with the aperture in the natural stone tile.

It is an object of the present invention to create a drainage device of the aforementioned type, which will facilitate assembly of the drainage device together with a floor tile.

SUMMARY OF THE INVENTION

According to the invention, the drainage device, when at least partially assembled in the floor area, is made up of at least two parts moveable relative to one another, in such a way that through a movement of the parts relative to one another the aperture on the floor tile can be moved in relation to the parts preassembled in the floor area. This means that when fitting the floor tile it can be shifted, where necessary together with parts of the drainage device that are or can be fitted thereto, in relation to parts already preassembled in the floor area, in such a way that despite the already partially preinstalled drainage device the position of the floor tile can still be adjusted to the local conditions.

According to the invention, the aperture in the floor tile and the upper inlet aperture of the drainage device can be made to coincide at least partially with one another through a movement of the parts relative to one another. By means of parts moveable against one another in this way, an aperture in a floor tile in the form of a natural stone floor tile, for example, can with comparative ease be made to coincide with the inlet aperture.

The parts of the drainage device moveable relative to one another can feasibly take the form of pipe lengths or tubular sections arranged at least partially one inside the other, which in particular enclose a deformable annular space or partially annular space between them.

At the same time, the inner pipe length or the inner tubular section may have an upper flange extending radially outwards, which is supported so that it is moveable horizontally.

At the same time, the outer pipe length or the outer tubular section may furthermore have an upper flange extending radially outwards.

In particular, the flange of the inner pipe length or the inner tubular section may at the same time be arranged, at least in sections, parallel to and at a distance from the flange of the outer pipe length or the outer tubular section. The mobility of the two parts relative to one another therefore stems from the mobility of the flanges arranged parallel to and a distance from one another.

According to the invention, the drainage device may furthermore comprise at least one seal, which seals the flange of the inner pipe length or the inner tubular section against the flange of the outer pipe length or the outer tubular section. The flanges are therefore moveable relative to one another and at the same time serve to seal the two parts against one another.

At least one seal can feasibly take the form of an O-ring.

Alternatively, it is possible for at least one seal to take the form of a corrugated bellows seal.

The flange of the outer pipe length or the outer tubular section may be bent upwards at its radially outer end, so that the bend thereby produced peripherally encloses the flange of the inner pipe length or the inner tubular section, at least in sections.

At the same time, at least one seal may be arranged between the outer edge of the flange of the inner pipe length or the inner tubular section and the bend peripherally enclosing this flange. The bend is therefore a simple means for permitting the arrangement of a seal, which may take the form of a corrugated bellows, for example.

Alternatively or in addition the flange of the outer pipe length or the outer tubular section may be bent upwards and radially inwards at its radially outer end, so that the bend thereby produced is arranged at least partially above the flange of the inner pipe length or the inner tubular section.

At the same time, at least one seal may be arranged between the bend, which extends at least partially above the flange of the inner pipe length or the inner tubular section, and the upper side of the flange of the inner pipe length or the inner tubular section. Such a double bend can therefore also readily facilitate the arrangement of the seal, which takes the form, for example, of an O-ring.

The drainage device can feasibly include two seals, which are arranged on the upper side and the underside of the flange of the inner pipe length or the inner tubular section.

In particular, one of the two seals may rest on the upper side of the flange of the outer pipe length or the outer tubular section and the other of the two seals may bear on the underside of the bend, which extends at least partially above the flange of the inner pipe length or the inner tubular section. The double bend therefore means that the flange of the inner pipe length or the inner tubular section can extend between two seals, which simultaneously bear against the flange of the outer pipe length or the outer tubular section and against the bend thereof. In this way the two flanges are readily sealed against one another whilst at the same time ensuring the mobility of the flanges relative to one another.

The outer pipe length or the outer tubular section can feasibly be part of a drain well. This enables an additional drain well to be dispensed with. Such an embodiment therefore manages with fewer parts and has a low overall height.

The parts moveable relative to one another may feasibly comprise a drain well, which is moveable in relation to parts preassembled in the floor area.

At the same time, the parts preassembled in the floor area may comprise seating devices capable of at least partially receiving the drain well, the drain well being moveable in relation to the seating devices. Such a development can also serve to ensure that the floor tile can still be moved in relation to the preinstalled seating devices.

At the same time the seating devices and the drain well can feasibly each comprise a union connection, the union connection of the drain well being at least partially received by the union connection of the seating devices.

At the same time, sealing devices, in particular a sealing ring or a lip packing, which allow a movement of the union connections relative to one another, may furthermore be arranged between the two union connections. The union connections, moveably arranged one inside the other by way of the sealing devices, readily permit movement of the drain well in relation to the seating devices. For example, the radially outer edge of the inner union connection may be separated at a distance from the radially inner edge of the outer union connection, in order to facilitate movement of the union connections relative to one another. The sealing devices can furthermore feasibly be radially widened in such a way as to facilitate movement of the union connections.

In particular, the floor tile can feasibly take the form of natural stone, a molding or a ceramic tile or the like. The drainage device can therefore be incorporated into a visually attractive flooring composed of natural stone, for example. Alternatively the drainage device may also be incorporated into a molding, which can serve as the base for a shower tray or the like.

BRIEF DESCRIPTION OF THE DRAWINGS

Further features and advantages of the present invention will be apparent from the following description of preferred exemplary embodiments, referring to the drawings attached, in which.

DETAILED DESCRIPTION OF THE INVENTION

Figure 1:
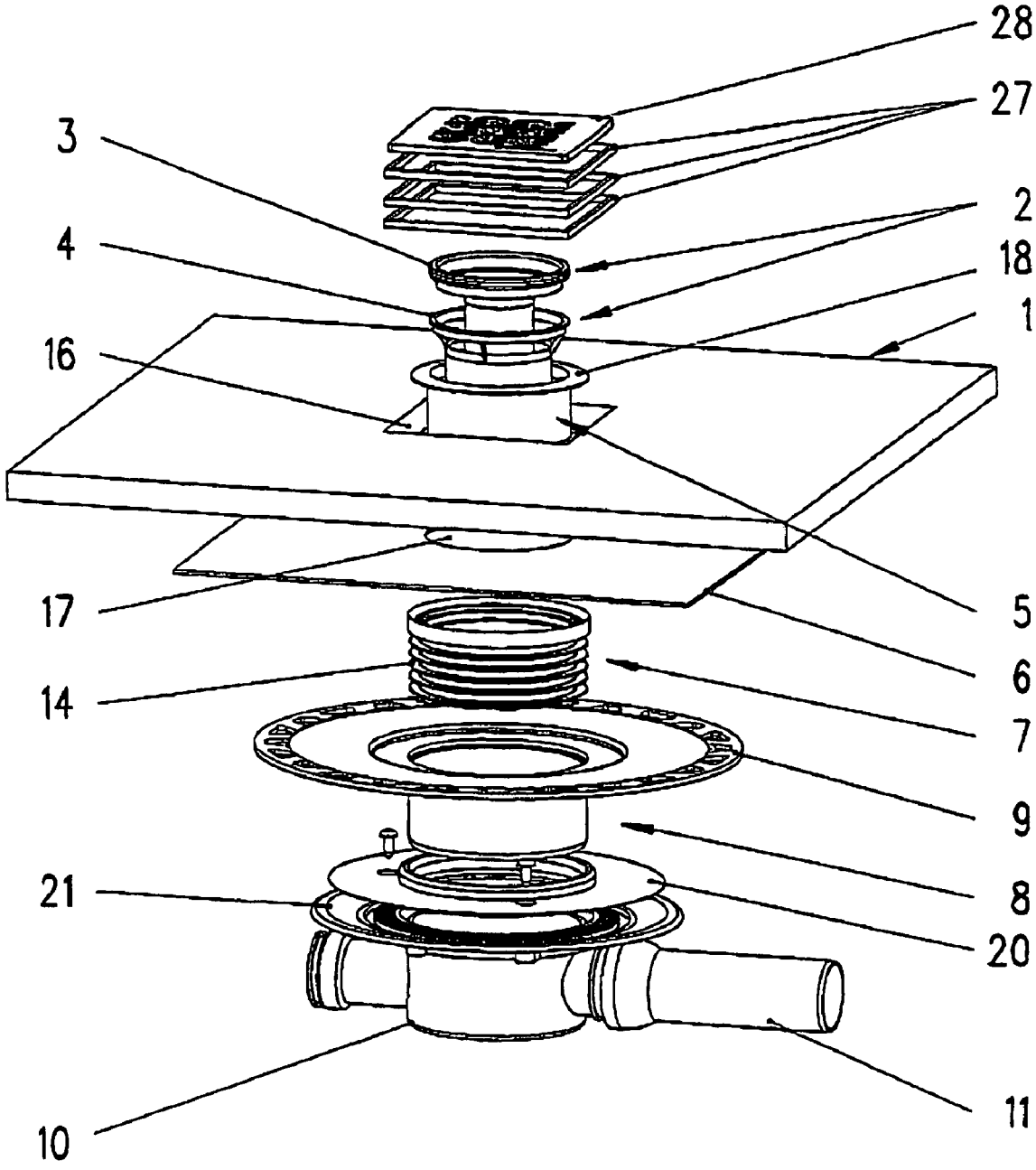
FIG. 1 shows an exploded view of a drainage device arranged on a floor tile.

The arrangement shown in FIG. 1 is made up of a floor tile 1 and a drainage device. The drainage device includes an odor trap unit 2 having an inner part 3 and an outer part 4, a first fixing part 5, a sheet metal plate 6, a second fixing part 7, a pipe length 8 having a flange 9, and a drain well 10. In the exemplary embodiment shown the drain well 10 is connected to a drainage pipe 11, which extends horizontally to the side.

Figure 2:
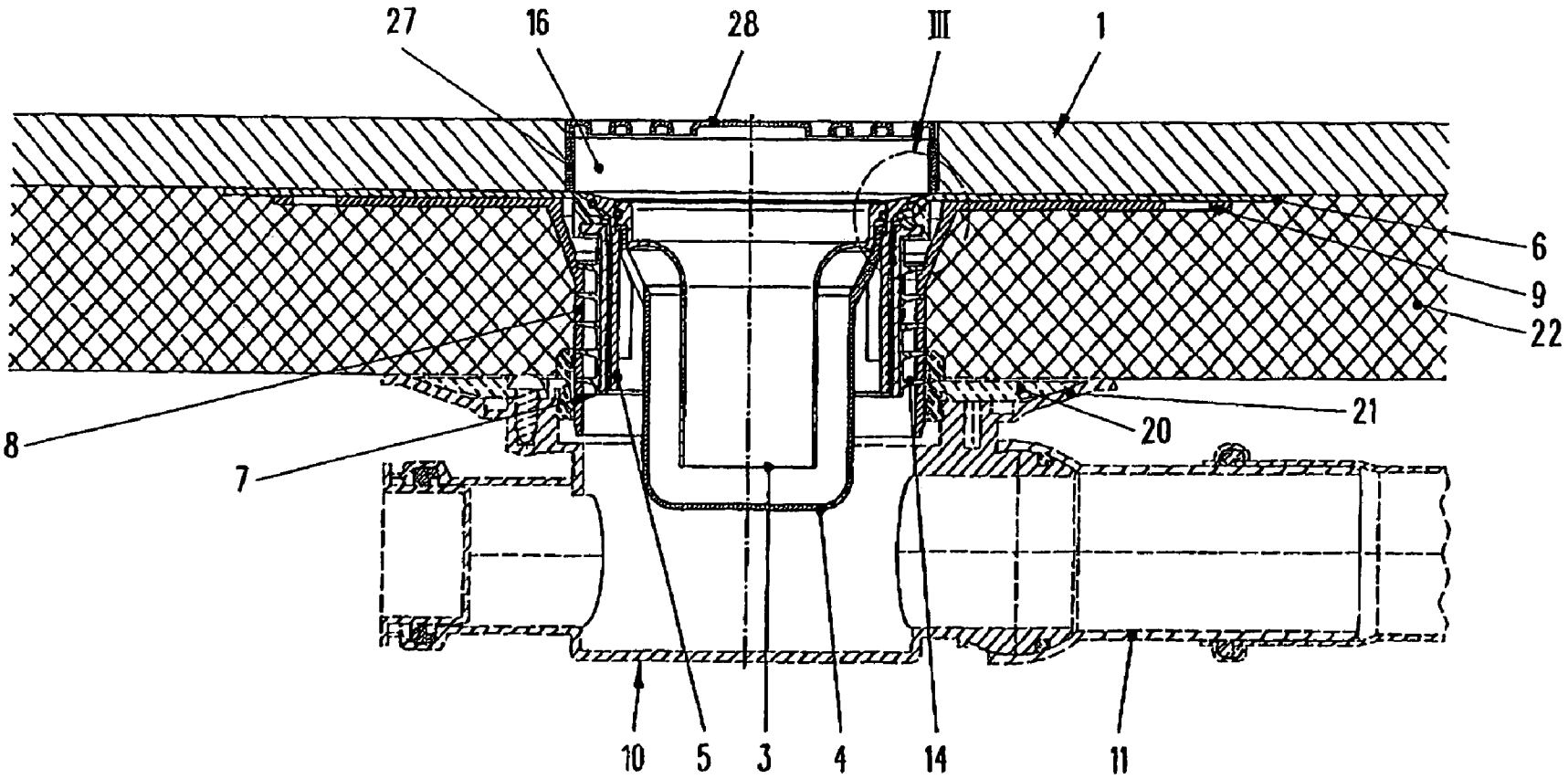
FIG. 2 shows a vertical section through the arrangement according to FIG. 1.

It can be seen from the sectional view in FIG. 2, in particular, that the odor trap unit 2 is of conventional siphonic construction. The inner part 3 extends in the form of a pipe union connection, open at the bottom, into the outer part 4, which is closed off at the bottom like a well, and has an overflow at the top.

Figure 3:
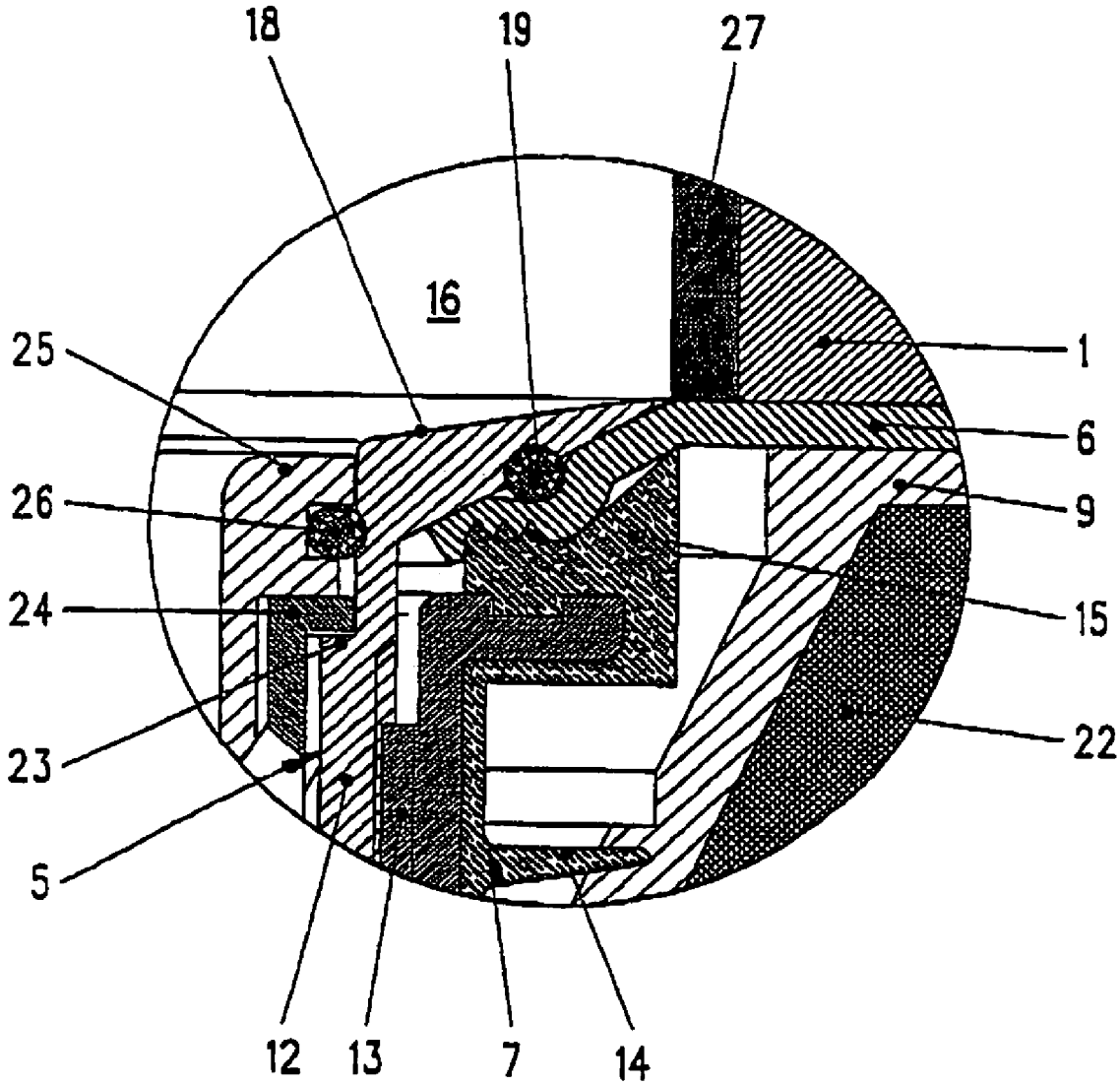
FIG. 3 shows a detailed view in the direction of the arrow III according to FIG. 2.
Figure 4:
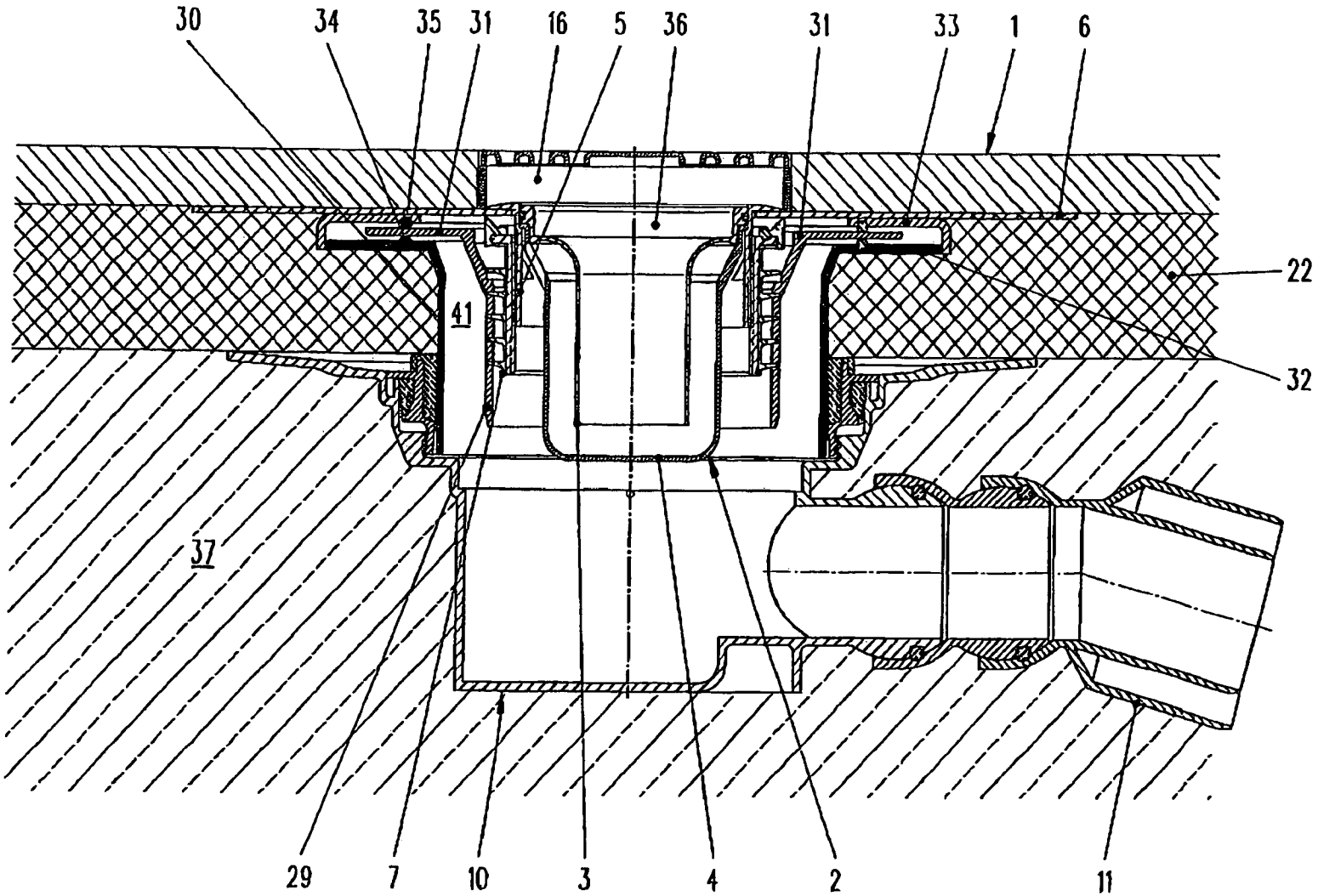
FIG. 4 shows a vertical section through a first embodiment of a drainage device according to the invention arranged on a floor tile.

It can also be seen from FIG. 2 and FIG. 3 that the first fixing part 5 has an external thread 12 on its outside, whereas the second fixing part 7 has an internal thread 13 on its inside. In FIG. 2 and FIG. 3 the internal thread 13 and the external thread 12 are in engagement with one another.

It can furthermore be seen both from FIG. 1 and from FIG. 2 and FIG. 3 that the second fixing part 7 has a lip packing 14 on its outside. As can be seen in detail from FIG. 3, the sealing material forming the lip packing 14 extends upwards on the outside of the second fixing part 7, so that the upper edge of the second fixing part 7 is likewise covered by a peripheral seal 15. As can further be seen from FIG. 3, with the drainage device in the assembled state this upper peripheral seal 15 bears on a partial area of the underside of the sheet metal plate 6.

In the exemplary embodiment shown, the floor tile 1 has an aperture 16 having a basically square outline. However, an aperture having a circular outline or an aperture of some other shape may well be selected instead of an aperture 16 with a square outline, The sheet metal plate 6 furthermore has an aperture 17 which in the exemplary embodiment shown is provided with a circular outline. This aperture 17 may also have other outlines. The edge of the plate 6 enclosing the aperture 17 is furthermore bent downwards somewhat.

As can be seen from FIG. 1 and FIG. 3, for example, the first fixing part 5 has an upper flange 18 extending radially outwards, which with the drainage device in the assembled state rests on the somewhat down-turned edge around the aperture 17 in the plate 6. FIG. 3 in particular shows that a seal 19, especially one in the form of an O-ring, which seals the first fixing part 5 against the plate 6, is provided between the underside of the flange 18 of the first fixing part 5 and the upper side of the plate 6 in the area of the slightly down-turned edge. The seal 19 and the peripheral seal 15 therefore serve respectively to seal the plate 6 from the top and from the bottom in relation to the first fixing part 5 and the second fixing part 7.

The plate 6 can be fixed to the underside of the floor tile 1. In particular the plate 6 may be bonded to the underside of the floor tile 1 when assembling the drainage device. Alternatively, before any abrasive machining of the floor tile in order to obtain a slope, the plate 6 may also be bonded under the floor tile in order to stabilize it. The plate 6 may feasibly comprise at least one bead or a depression, which serve to strengthen the plate 6.

A ceramic tile, which with the drainage device in the assembled state bears on the underside of the plate 6 and in this way contributes to the sealing effect, may be laid on the upper side of the flange 9 of the pipe length 8.

A further disk-shaped seal 20, visible in particular from FIG. 1, may be arranged between the pipe length 8 with flange 9 and the drain well 10. In the exemplary embodiment depicted here the drain well 10 has a upper flange 21 extending radially outwards, on which the disk-shaped seal 20 can rest. In particular the disk-shaped seal 20 may be screwed to the flange 21 of the drain well (see FIG. 2). FIG. 2 furthermore shows a part of the floor, that is to say a screed layer 22, into which the drainage device is at least partially inserted. In particular, the disk-shaped seal 20 here seals the lower part of the drainage device in relation to the underside of the screed layer.

In the embodiments according to FIG. 1 to FIG. 7, it is quite possible for the drainage pipe 11 to extend vertically downwards from the drain well 10 rather than horizontally sideways.

In FIG. 2 the drain well 10 and the drainage pipe 11 are drawn in with dashed lines. This dashed representation of the drain well is intended to illustrate that instead of the drain well 10 it is also possible simply to use a drainage pipe extending vertically downwards, into which, for example, the second fixing part 7 is inserted with its lip packing 14.

In the exemplary embodiment shown the drainage device according to the invention is assembled and the arrangement according to the invention is obtained by first installing the drain well 10 and connecting it to one or more drainage pipes 11. A screed layer 22 is then applied, in which a corresponding aperture is recessed. Once the screed layer has dried, the pipe length 8 which extends through the aperture into the area of the seal 20, or to the upper edge of the drain well 10, is introduced into the aperture. At the same time the flange 9 of the pipe length 8 is applied to the screed layer around the aperture.

The second fixing part 7 is then introduced into the pipe length 8. The lip packing 14 serves to produce a comparatively firm and secure connection between the second fixing part 7 and the pipe length 8.

The plate 6 is then bonded to the underside of the floor tile 1, so that the two apertures 16, 17 correspond to one another. Alternatively the plate 6 may also have been bonded to the underside of the floor tile 1 prior to assembly, particularly in order to stabilize the latter. The floor tile 1 is then applied onto the screed layer 22 in the area of the flange 9 in such a way that the apertures 16, 17 correspond or align with the corresponding aperture in the screed layer, or with the pipe length 8.

The first fixing part 5 is then introduced through the aperture 16 in the floor tile 1 into the second fixing part 7 and is screwed into the latter. By screwing the fixing parts 5 and 7 together, the upper flange 18 of the first fixing part 5 is pressed downwards against the plate 6, whereas the upper edge of the second fixing part 7 provided with the peripheral seal 15 is pressed upwards against the plate 6. In this way a secure, tight connection is produced between the plate 6 and the fixing part 5, 7.

The odor trap unit 2 is then likewise pushed into the first fixing part 5 from above through the aperture 16. Arranged in its upper area, the first fixing part 5, as can be seen in particular from FIG. 3, has an inner seat 23 for the odor trap unit 2. For this purpose the outer part 4 of the odor trap unit 2 is equipped with an edge 24 extending radially outwards, which can rest on the seat 23. A similarly outwards extending edge 25 of the inner part 3 rests on this edge 24 of the outer part 4. As can likewise be seen from FIG. 3, a groove in which an O-ring 26, which seals the odor trap unit 2 against the inner edge of the first fixing part 5, is provided in the upper edge 25 of the inner part 3 of the odor trap unit 2.

In the embodiment depicted in FIG. 1 to FIG. 3, after inserting the odor trap unit 2 three frames 27, which likewise have a square outline and fit with relative precision into aperture 16, are inserted into the aperture 16 of the floor tile 1. A grille 28 may be placed on top of these frames 27. According to the invention it is possible to use more or fewer frames 27. For example, a taller frame 27 might be used, which has the same height as the frames 27 arranged one on top of another.

In the case of the inventive drainage devices according to FIG. 4 to FIG. 7 identical parts are provided with the same reference numerals as in the arrangement according to FIG. 1 to FIG. 3. The main difference between these embodiments is that instead of one pipe length 8 with upper flange 9 the drainage devices according to the invention have two pipe lengths 29, 30 basically arranged coaxially with one another and with upper flanges 31, 32 (see FIG. 4 and FIG. 5).

In particular, the outer pipe length 30 engages in the drain well 10, whereas the inner pipe length 29 serves to receive the second fixing part 7. The pipe lengths 29, 30 are pushed one inside the other leaving a gap, so that they can be moved in a horizontal and/or radial direction relative to one another. A deformable annular space 41 is therefore formed between the two pipe lengths 29, 30.

At the same time the flange 32 of the outer pipe length 30 at its radially outer end is bent twice by 90°, first upwards and then inwards, so that its bend 33 runs above the flange 31 of the inner pipe length 29. The flange 31 of the inner pipe length 29 is therefore partially enclosed by the flange 32 of the outer pipe length 30. In this area a seal 34, 35 in the form of an O-ring is provided both above and below the flange 31 of the inner pipe length 29. The flange 31 of the inner pipe length 29 can be shifted to left and right in FIG. 4 between these seals 34, 35, so that the inner pipe length 29 is moved relative to the outer pipe length 30.

In this way, however, the upper inlet aperture 36 of the drainage device, which is passed through the central area of the upper aperture of the inner pipe length 29, is also moved relative to the outer pipe length 30 and the drain well 10 already firmly installed in the floor.

The drainage device can therefore be installed in such a way that the drain well 10 is first installed with the two pipe lengths 29, 30 arranged coaxially with one another. Here the drain well 10 may be situated in the concrete floor 37 and the outer pipe length 30 in the screed layer. The second fixing part 7 may furthermore be pushed into the inner pipe length 29.

If the floor tile 1, possibly in the form of a heavy natural stone tile, is then placed together with the sheet metal plate 6 on top of the screed layer 22, the inner pipe length 29 can be shifted in a horizontal direction until the aperture 16 in the floor tile 1 basically aligns with the upper inlet aperture 36 of the drainage device. Only then is the first fixing part 5 introduced into the second fixing part 7 and screwed tight. This also means that the upper inlet aperture 36 is fixed in its optimum position. The correct height of the odor trap unit 2 or the inlet aperture 36 can be adjusted by vertical displacement of the second fixing part 7 in the inner pipe length 29.

Figure 5:
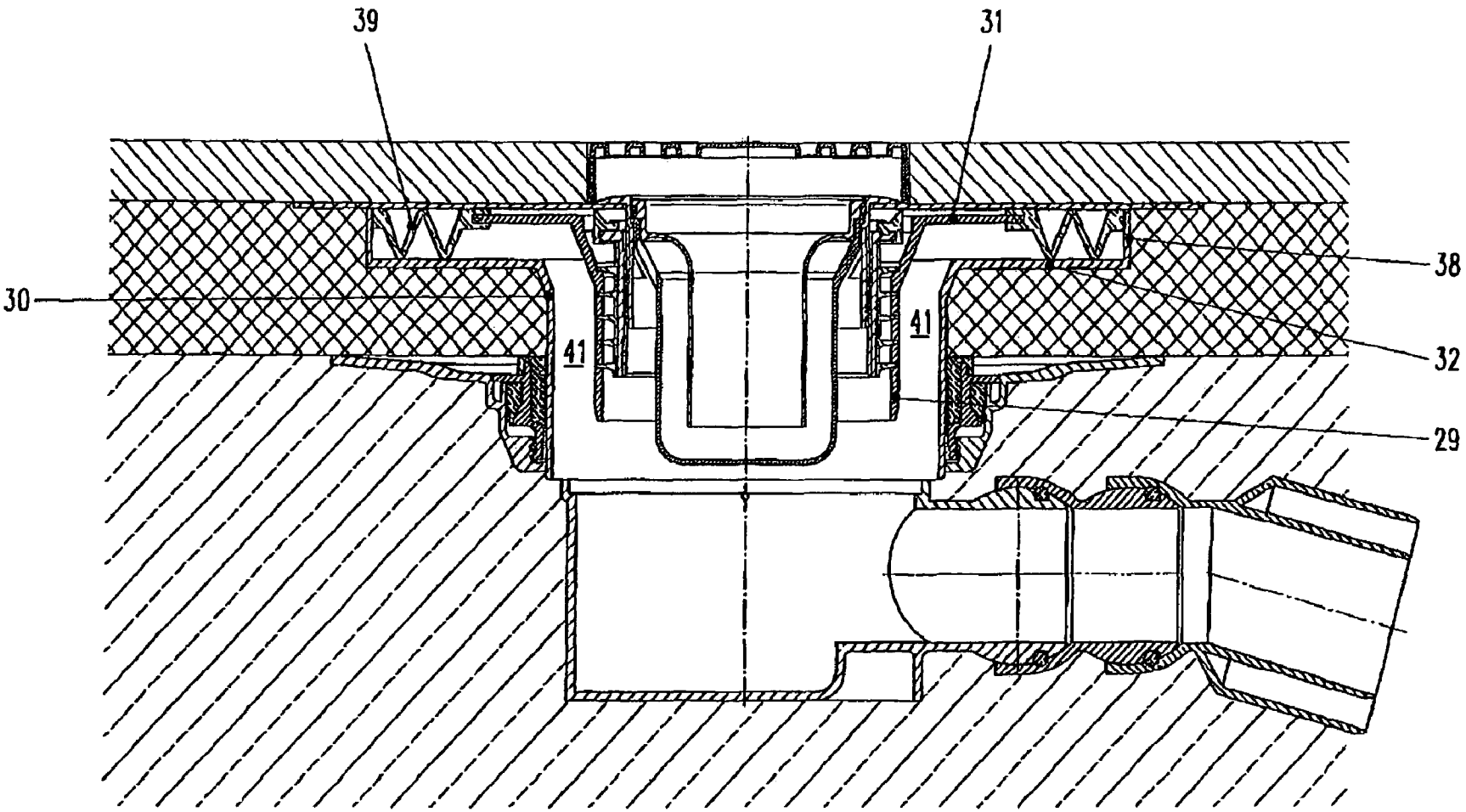
FIG. 5 shows a vertical section through a second embodiment of a drainage device according to the invention arranged on a floor tile.

In the embodiment according to FIG. 5 only a single bend 38 rather than a double bend is provided at the flange 32 of the outer pipe length 30. The flange 31 of the inner pipe length 29 is moreover not enclosed by the flange 32 but is held by a corrugated bellows seal 39, which peripherally encloses the flange 31. This seal 39 also permits a relative movement between the inner pipe length 29 and the outer pipe length 30.

Figure 6:
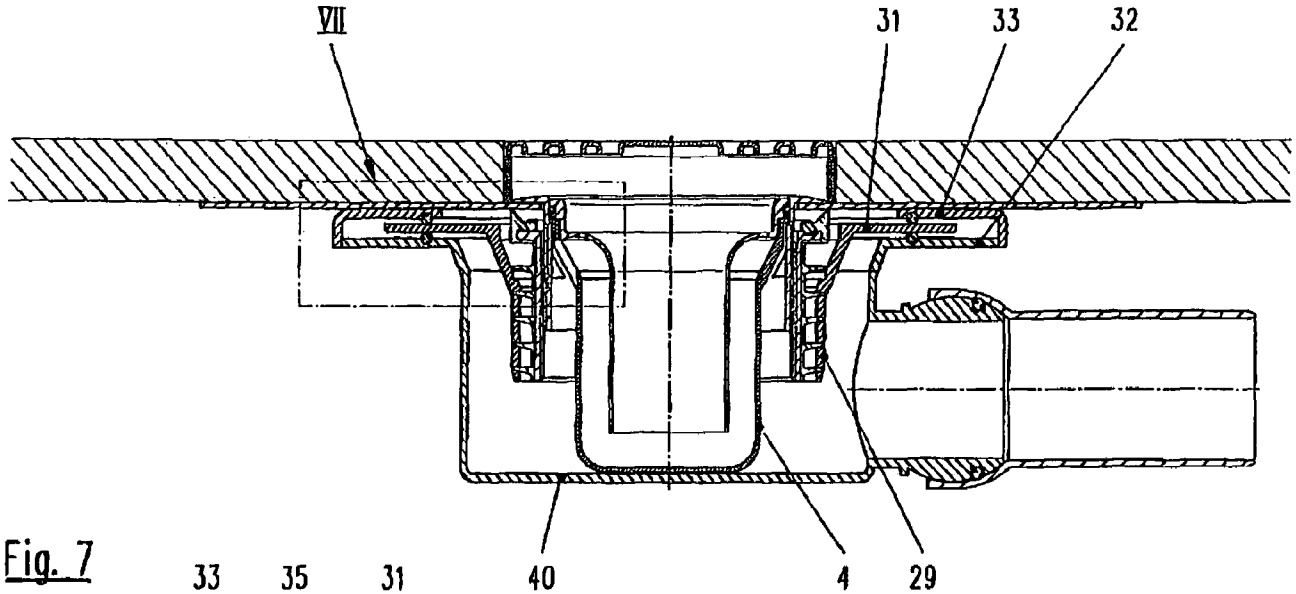
FIG. 6 shows a vertical section through a third embodiment of a drainage device according to the invention arranged on a floor tile.
Figure 7:
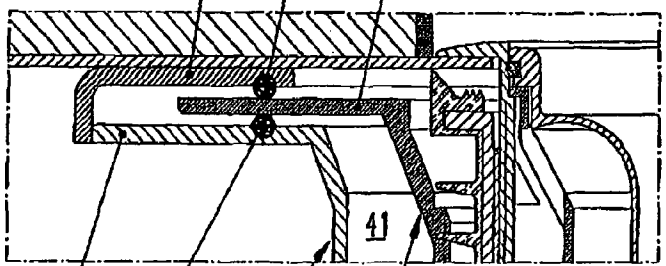
FIG. 7 shows a detailed view in the direction of the arrow VII in FIG. 6.

In the embodiment according to FIG. 6 and FIG. 7 the outer pipe length 40 forms a drain well, so that an additional drain well can be dispensed with. This embodiment therefore manages with fewer parts and has a lower overall height.

In the embodiments according to FIG. 8 to FIG. 13 identical parts are provided with the same reference numerals as in FIG. 1 to FIG. 7. The main difference between these embodiments and those according to FIG. 4 to FIG. 7 is that here the facility for displacement occurs between a drain well and well-like seating devices rather than between a pipe length open at the bottom and a drain well.

Figure 8:
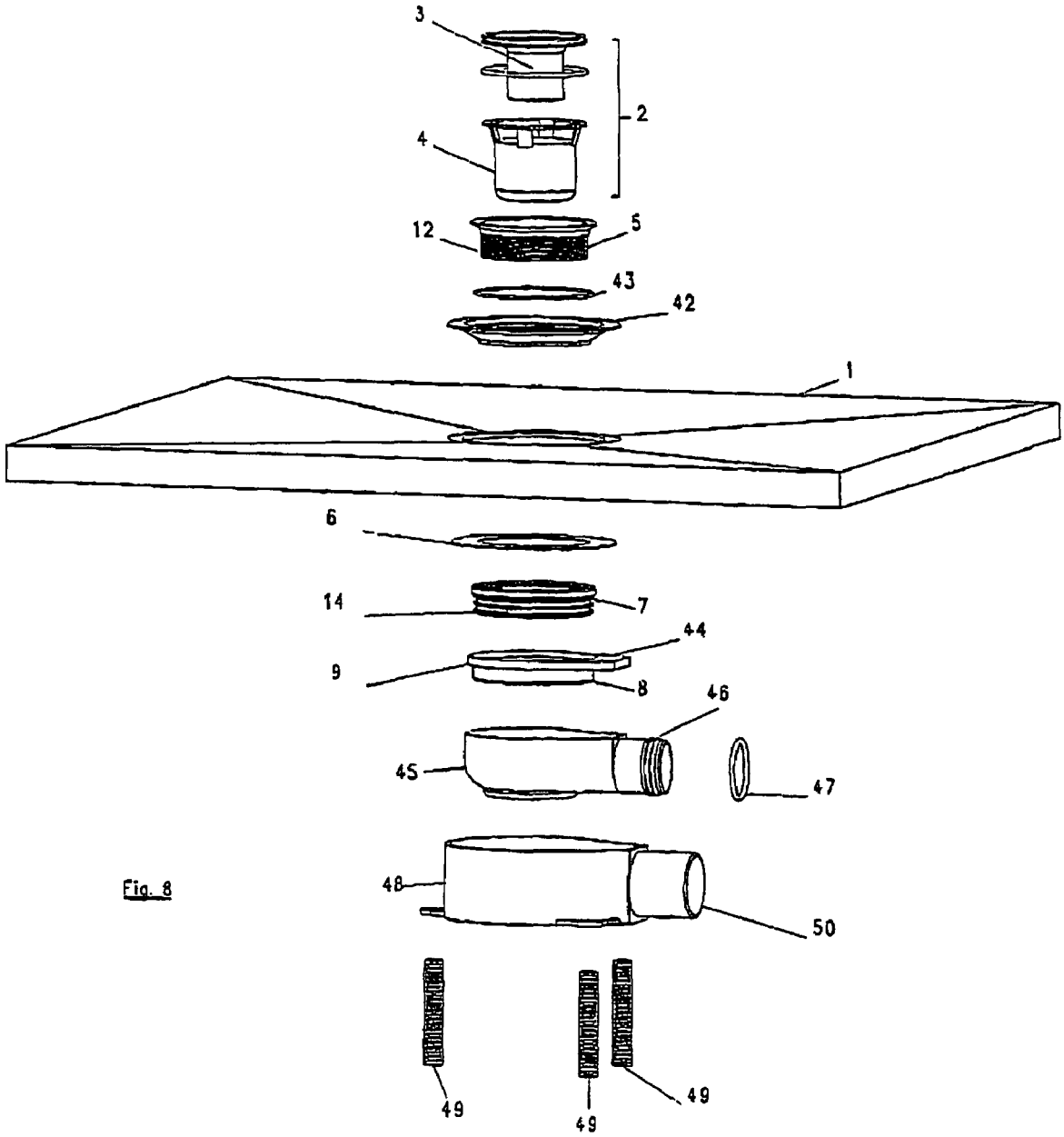
FIG. 8 shows an exploded view of further embodiment of a drainage device according to the invention arranged on a floor tile.

It can be seen from FIG. 8 that the plate 6 in the embodiment depicted in FIG. 8 to FIG. 11*e* has a distinctly smaller diameter than in the embodiments according to FIG. 1 to FIG. 7. The peripheral seal 15 of the second fixing part 7 also forms a seal against the underside of the comparatively small plate 6 (see FIG. 9).

The embodiment shown in FIG. 8 furthermore comprises a plate-like insert 42, which bears on the inside of the aperture 16 of the floor tile 1 and also rests on the floor tile 1 in the area surrounding the aperture 16. The insert 42 may be made of steel. On the side remote from the inside of the aperture 16, the insert 42 has a groove in which a sealing ring 43 is arranged, which forms a seal between the insert 42 and the upper flange 18 of the first fixing part 5 (see FIG. 9).

Figures 9, 10:
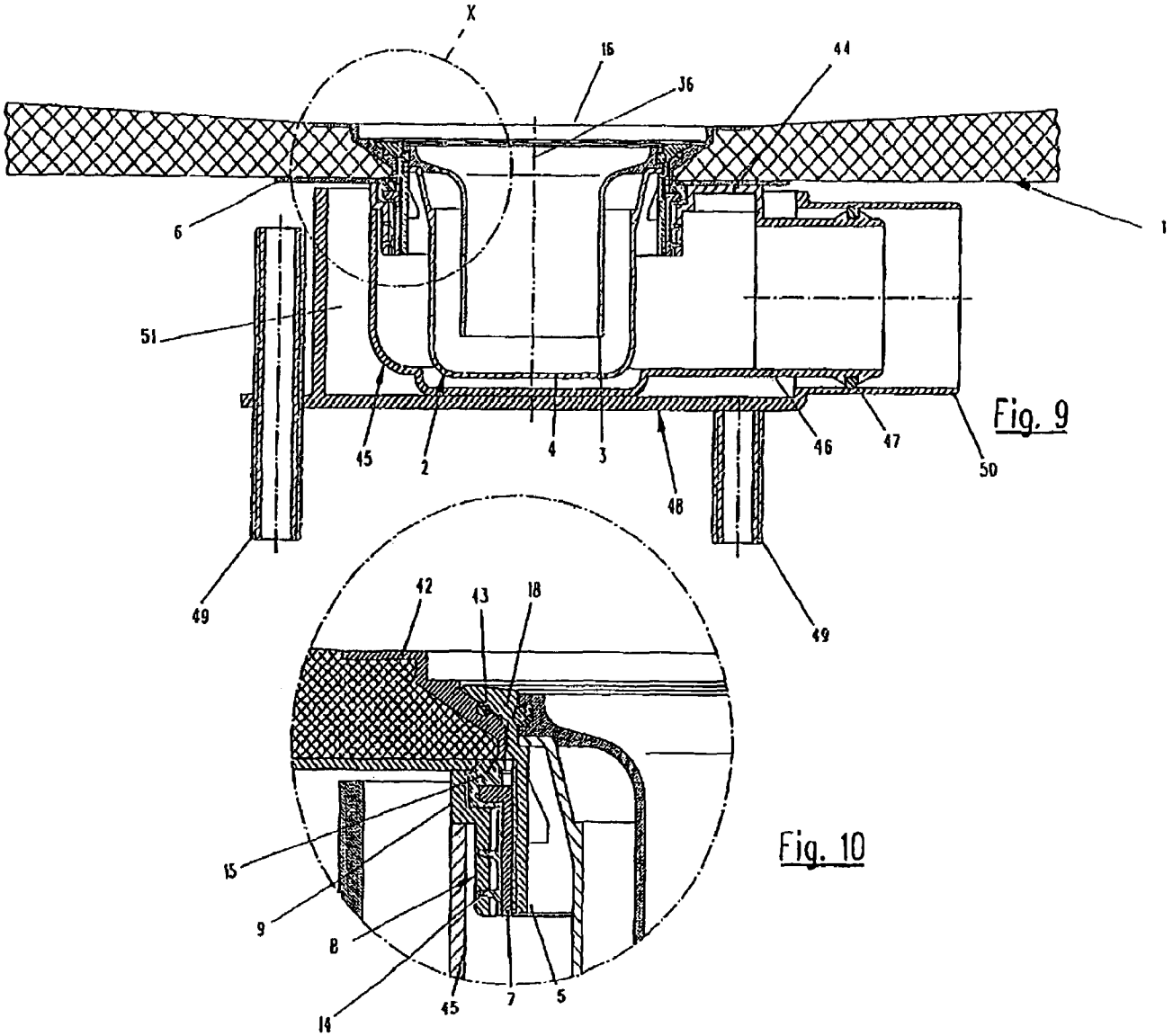
FIG. 9 shows a vertical section through the drainage device according to FIG. 8.
FIG. 10 shows a detailed view in the direction of the arrow X in FIG. 9.

In the embodiment according to FIG. 8 to FIG. 11*e* the flange 9 of the pipe length 8 is, over the greater part of its periphery, smaller than in the preceding exemplary embodiments and has a projection 44 extending to the right in FIG. 8 and FIG. 9. As in the preceding examples, the lip packing 14 of the second fixing part 7 forms a seal against the inside of the pipe length 8.

A drain well 45 of the arrangement according to FIG. 8 to FIG. 11*e* largely encloses the odor trap unit 2 and the pipe length 8, which with its flange 9 partially rests on the upper edge of the drain well 45. In FIG. 9 the drain well 45 has a union connection 46 on the right-hand side thereof. A sealing ring 47 is arranged in a groove on the periphery of the union connection 46.

The drain well 45 is received in seating devices 48, which may be preinstalled in the screed layer, for example. For this purpose the seating devices 48 have height-adjustable support feet 49. The seating devices 48 are furthermore basically of well-shaped design and have a union connection 50 extending to the right in FIG. 9, in which the union connection 46 of the drain well 45 is received. At the same time the sealing ring 47 bears on the inside of the union connection 50 of the seating devices 48. A drainage pipe (not shown) can be connected to the union connection 50.

In the embodiment according to FIG. 8 to FIG. 11*e* also, the drain well 45 and the seating devices 48 have tubular sections arranged one inside the other, which enclose a deformable partially annular space 51 between them.

Figure 11A:
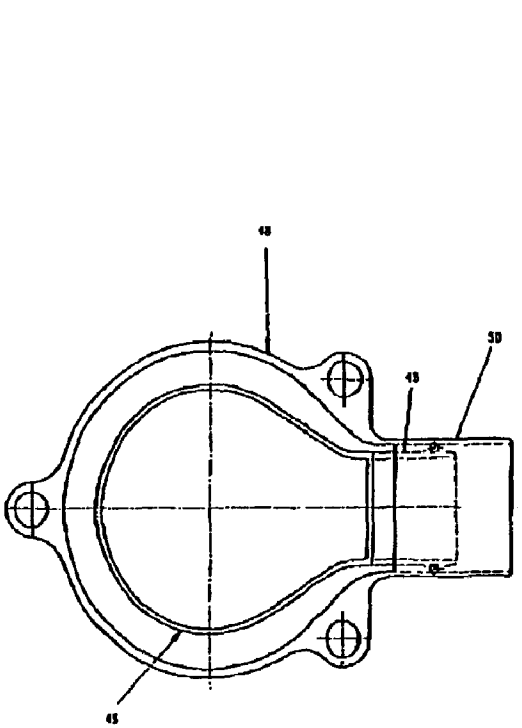
FIG. 11*a* shows a schematic plan view of the drainage device according to FIG. 8 in a first position.
Figure 11C:
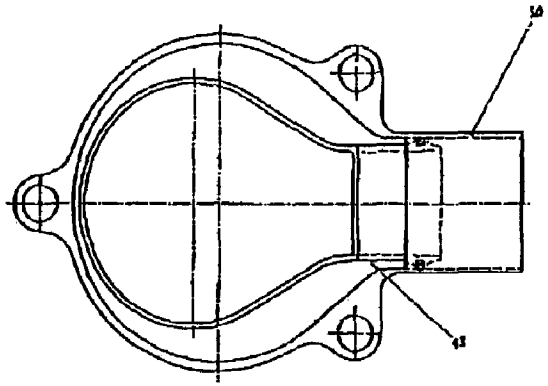
FIG. 11*c* shows a schematic plan view of the drainage device according to FIG. 8 in a third position.
Figure 11E:
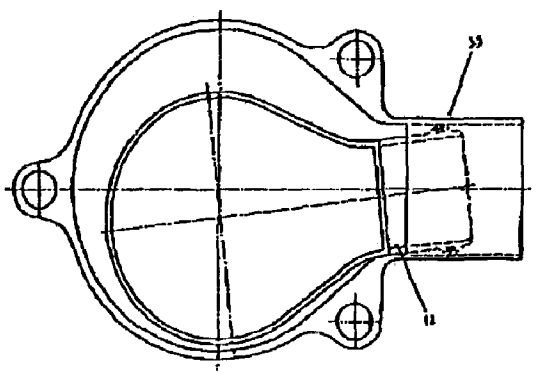
FIG. 11*e* shows a schematic plan view of the drainage device according to FIG. 8 in a fifth position.
Figure 11B:
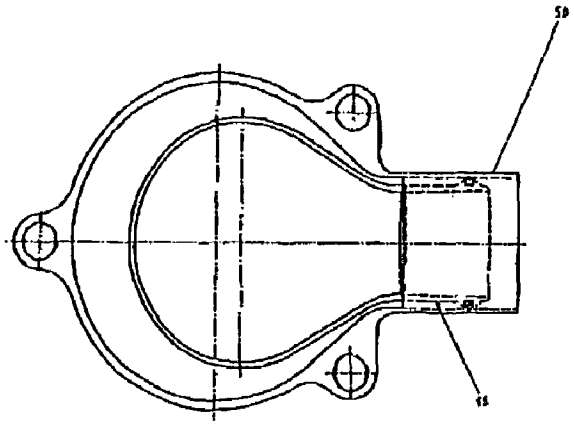
FIG. 11*b* shows a schematic plan view of the drainage device according to FIG. 8 in a second position.
Figure 11D:
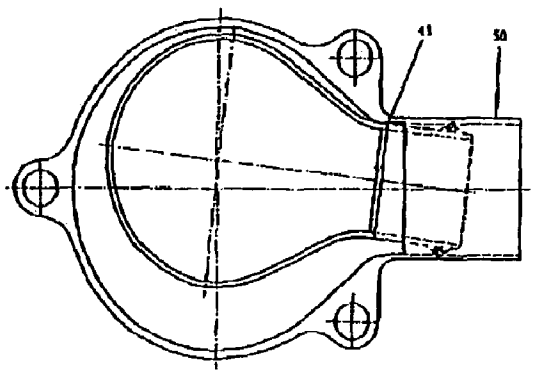
FIG. 11*d* shows a schematic plan view of the drainage device according to FIG. 8 in a fourth position.

The diameter of the union connections 46, 50 and the size and consistency of the sealing ring 47 are selected so that the union connection 46 is moveable or displaceable or capable of swiveling in the union connection 50 within a certain range. FIG. 11*a* shows a position of the union connection 46 in the union connection 50, in which the center points of the drain well 45 and the seating devices 48 basically align with one another in a vertical direction. FIG. 11*b* to FIG. 11*e* show positions in which the drain well 45 is offset in relation to the seating devices 48, that is to the right (FIG. 11*b*), to the left (FIG. 11*c*), upwards (FIG. 11*d*) or rearwards (in a view according to FIG. 9) or downwards (FIG. 11*e*) or forwards (in a view according to FIG. 9). When fitting the drainage device to the floor tile 1, therefore, this facility for displacement or swiveling allows the latter to be adjusted horizontally in relation to the seating devices 48 already preinstalled in the screed layer. A vertical adjustment can at the same time be performed by displacing the lip packing 14 in the pipe length 8.

Figure 12:
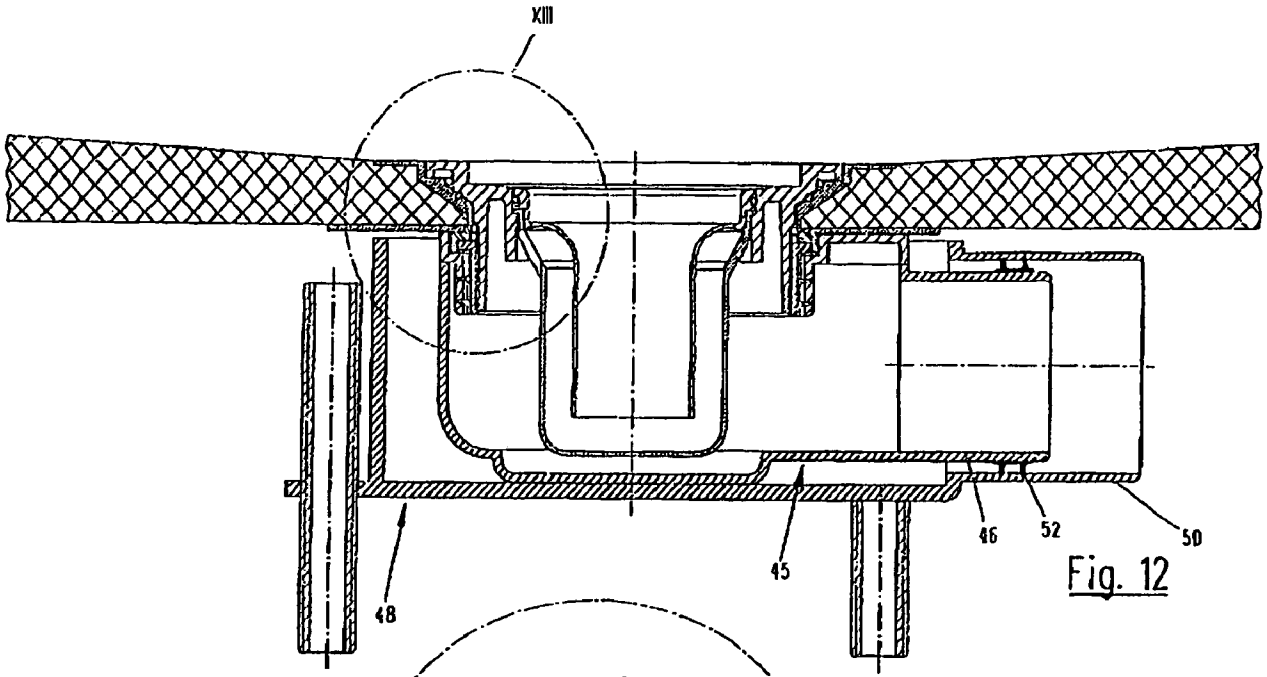
FIG. 12 shows a vertical section through a further embodiment of a drainage device according to the invention arranged on a floor tile.
Figure 13:
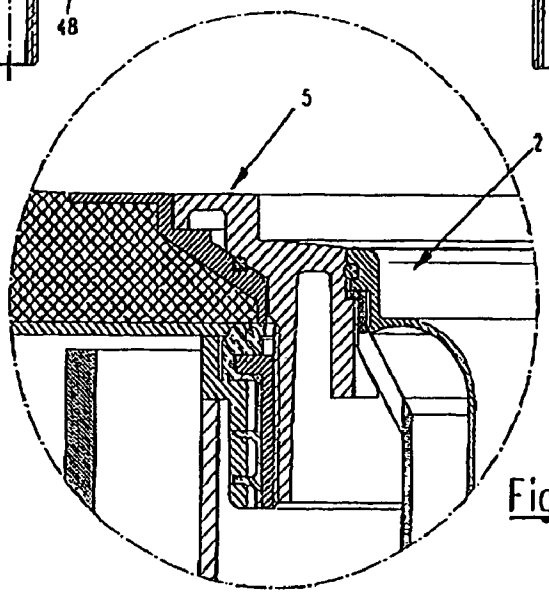
FIG. 13 shows a detailed view in the direction of the arrow XIII in FIG. 12.

The embodiment according to FIG. 12 and FIG. 13 basically differs from the embodiment according to FIG. 8 to FIG. 11*e* in that a lip packing 52 is provided instead of the sealing ring 47 arranged on the union connection 46. Like the sealing ring 47, however, this also allows the union connections 46, 50 to be displaced or swiveled in relation to one another. The first fixing part 5 moreover has a somewhat different shape, so that the odor trap unit 2 is supported somewhat differently to the embodiment in FIG. 8 to FIG. 11*e*.

A drain well 45 with a lip packing 52 can also feasibly be combined with a first fixing part 5 of the embodiment according to FIG. 8 to FIG. 11*e*. A drain well 45 having a sealing ring 47 may furthermore also be provided in the case of a first fixing part 5 of the embodiment according to FIG. 12 and FIG. 13.

What is claimed is:

1. A drainage device for arrangement on a floor tile having an aperture for drain water, comprising an upper inlet aperture into which drain water, having passed through the aperture in the floor tile can enter, parts preassembled in the floor area, which can be connected to a drainage pipe so that drain water, having passed through the inlet aperture, can pass into the drainage pipe, two parts, which when assembled at least partially in the floor area are moveable relative to one another, in such a way that their movement relative to one another allows the aperture in the floor tile to be moved in relation to the parts preassembled in the floor area, wherein the parts of the drainage device moveable relative to one another take the form of pipe lengths or tubular sections arranged at least partially one inside the other, which enclose a deformable annular space or partially annular space between them and wherein the inner pipe length or the inner tubular section has an upper flange extending radially outwards, which is supported so that it is horizontally moveable and wherein the flange of the outer pipe length or the outer tubular section is bent upwards and radially inwards at its radially outer end, so that the bend thereby produced is arranged at least partially above the flange of the inner pipe length or the inner tubular section.

2. The drainage device as claimed in claim 1, wherein the aperture in the floor tile and the upper inlet aperture of the drainage device can be made to coincide at least partially with one another through a movement of the parts relative to one another.

3. The drainage device as claimed in claim 1, wherein the inner pipe length or the inner tubular section has an upper flange extending radially outwards, which is supported so that it is horizontally moveable.

4. The drainage device as claimed in claim 1, wherein a flange of an inner pipe length or an inner tubular section is arranged, at least in sections, parallel to and at a distance from the flange of an outer pipe length or an outer tubular section.

5. The drainage device as claimed in claim 4, wherein the drainage device comprises at least one seal, which seals the flange of the inner pipe length or the inner tubular section against a flange of the outer pipe length or the outer tubular section.

6. The drainage device as claimed in claim 5, wherein at least one seal takes the form of an O-ring.

7. The drainage device as claimed in claim 5, wherein at least one seal takes the form of a corrugated bellows seal.

8. The drainage device as claimed in claim 1, wherein the flange of the outer pipe length or the outer tubular section is bent upwards at its radially outer end, so that the bend thereby produced peripherally encloses the flange of the inner pipe length or the inner tubular section, at least in sections.

9. The drainage device as claimed in claim 8, wherein at least one seal is arranged between the outer edge of the flange of the inner pipe length or the inner tubular section and the bend peripherally enclosing this flange.

10. The drainage device as claimed in claim 1, wherein at least one seal is arranged between the bend, which extends at least partially above the flange of the flange of the inner pipe length or the inner tubular section, and the upper side of the flange of the flange of the inner pipe length or the inner tubular section.

11. The drainage device as claimed in claim 1, wherein the outer pipe length or the outer tubular section is part of a drain well.

12. An arrangement of a drainage device on a floor tile, comprising a floor tile having an aperture, through which drain water can pass, characterized by a drainage device as claimed in claim 1.

13. A drainage device for arrangement on a floor tile having an aperture for drain water, comprising an upper inlet aperture, into which drain water, having passed through the aperture in the floor tile, can enter.

parts preassembled in the floor area, which can be connected to a drainage pipe, so that drain water, having passed through the inlet aperture, can pass into the drainage pipe, two parts, which when assembled at least partially in the floor area are moveable relative to one another, in such a way that their movement relative to one another allows the aperture in the floor tile to be moved in relation to the parts preassembled in the floor area, wherein the parts of the drainage device moveable relative to one another take the form of pipe lengths or tubular sections arranged at least partially one inside the other, which in particular enclose a deformable annular space or partially annular space between them and wherein the inner pipe length or the inner tubular section has an upper flange extending radially outwards, which is supported so that it is horizontally moveable and wherein the drainage device comprises two seals, which are arranged on the upper side and the underside of the flange of the inner pipe length or the inner tubular section.

14. The drainage device as claimed in claim 13, wherein one of the two seals rests on the upper side of the flange of the outer pipe length or the outer tubular section and the other of the two seals bears on the underside of the bend, which extends at least partially above the flange of the inner pipe length or the inner tubular section.

* * * * *